United States Patent [19]

Mixon, Jr.

[11] Patent Number: 4,605,279

[45] Date of Patent: Aug. 12, 1986

[54] ELECTRICAL TERMINAL

[75] Inventor: James L. Mixon, Jr., Harrisburg, Pa.

[73] Assignee: AMP Incorporated, Harrisburg, Pa.

[21] Appl. No.: 790,545

[22] Filed: Oct. 23, 1985

[51] Int. Cl.[4] ..... H01R 4/26

[52] U.S. Cl. ..... 339/276 R; 29/876; 72/404

[58] Field of Search ..... 339/276, 252 R, 277 R, 339/256 SP; 72/335, 338, 404; 29/876, 878

[56] References Cited

U.S. PATENT DOCUMENTS 1,608,578 11/1926 Buchenberg ..... 339/276 T
1,798,812 3/1931 Rosenbeck ..... 339/276 T

FOREIGN PATENT DOCUMENTS 2118577 11/1971 Fed. Rep. of Germany ..... 339/256 SP
426937 4/1935 United Kingdom ..... 339/277 R

*Primary Examiner*—Eugene F. Desmond
*Attorney, Agent, or Firm*—Allan B. Osborne

[57] ABSTRACT

An electrical terminal having a coined rib for contact section rigidity and for increased crimp pressure against a wire in the wire barrel. The terminal, stamped and formed from thin metal stock, meets electrical and mechanical requirements and is lower in manufacturing costs.

20 Claims, 8 Drawing Figures

ELECTRICAL TERMINAL

FIELD OF THE INVENTION

The present invention relates to electrical terminals of the type to be connected to electrical conductors and particularly to terminals which are of the type having wire barrels designed to be crimped into interlocking and good electrically conductive engagement with the stripped conductor ends.

BACKGROUND OF THE INVENTION

Electrical terminals have heretofore been stamped and formed from heavy gauge metal to provide both strength and adequate electrical conductivity.

With regard to the first requirement, it is well known that the contact section, be it a ring tongue or other suitable shape, is subjected to deformation through careless handling, improper installation and other similar abuses. Accordingly, industry has, since the inception of electrical terminals, tended to make such contact sections reasonably sturdy.

Wire barrels, either open or closed, of the crimpable type, also needed to be substantial in order to withstand crimping pressures.

With regard to electrical conductivity, workers in the field have always designed electrical terminals to have more current carrying capability than the size conductor to which it was intended to be attached. In most cases, terminals in fact have much more conductivity than required.

In summary, contemporary electrical terminals are well designed to meet the requirements and are in fact, over designed with a corresponding higher cost.

SUMMARY OF THE INVENTION

The objective of the present invention is providing a less expensive electrical terminal without reducing the physical strength and electrical conductivity below that which is required. Accordingly, a stamped and formed electrical terminal is provided which comprises a contact section at one end and a wire barrel at another end with an embossed strengthening rib extending around the periphery of the inside surface of the wire barrel and continuing out around the periphery of the contact section. A method of making the electrical terminal of the present invention is also disclosed.

Figure 1:
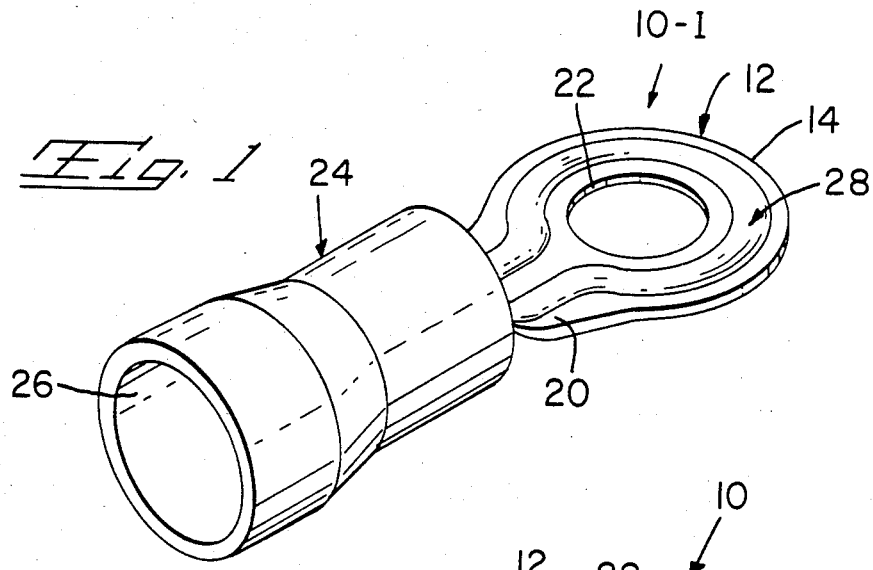
FIG. 1 is a perspective view of an electrical terminal, constructed in accordance with the present invention.
Figure 2:
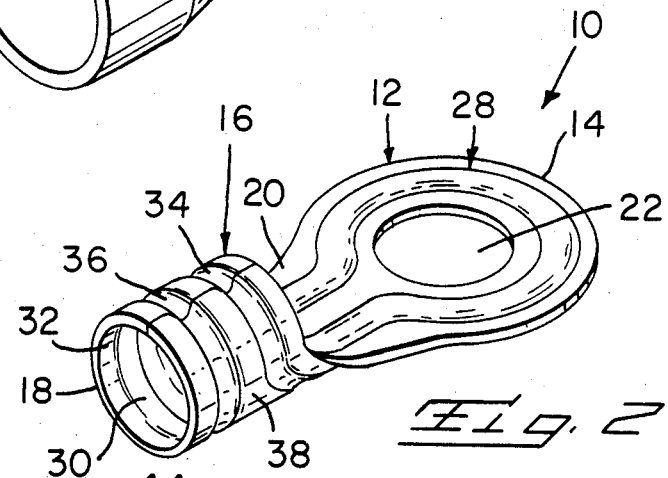
FIG. 2 is a perspective view of the electrical terminal of FIG. 1 with the insulation sleeve removed therefrom.

Electrical terminal 10-I shown in FIG. 1 and terminal 10 shown in FIG. 2 include a contact section 12 at front end 14 and wire barrel 16 at back end 18. Connecting strap 20 interconnects section 12 and barrel 16.

Contact section 12 is in the form of a ring tongue, having hole 22 therethrough to receive binding posts (not shown) or the like.

Terminal 10-I in FIG. 1 is identical to terminal 10 in FIG. 2 except for the presence of insulating sleeve 24 on the former. Sleeve 24, preferably of a thermo-set plastic, is molded over wire barrel 16. In addition to wire barrel 16, sleeve 24 provides a funnel 26 leading into barel 16 to facilitate inserting a stranded wire (FIGS. 5A, 5B) thereinto.

Terminals 10 further include at least one and preferably two ribs 28 and 30. Rib 28 encircles most of hole 22, extends along strap 20 and around most of the inside surface of wire barrel 16. Rib 30 extends completely around the inside surface of barrel 16 adjacent back end 18. As seen in FIG. 2 ribs 28, 30 project inwardly into passage 32 of barrel 16 and define groove 34, corresponding to rib 28 and groove 36, corresponding to rib 30, on exterior surface 38 of barrel 16.

Figure 3:
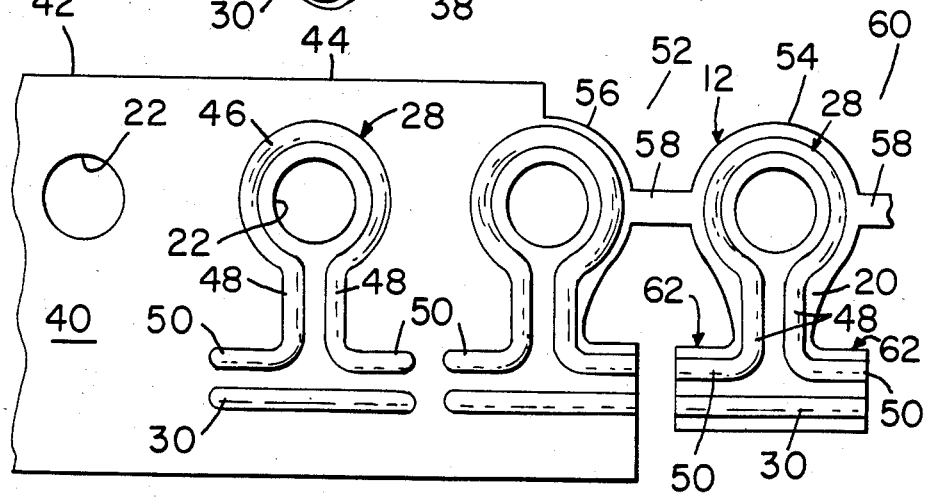
FIG. 3 is a top plan view showing progressions in stamping the electrical terminal from flat stock.

With reference to FIG. 3, electrical terminal 10 is stamped out from copper strip 40. For a terminal 10 having a wire barrel 16 sized to receive wire sizes 16, 14, strip 40 will have a thickness of 0.0167 inches (0.42 mm). Electrical terminals 10 for other wire sizes would have similar reduced metal requirements. The presence of rib 28, which increases the rigidity of contact section 12 and provides high crimping pressure points in wire barrel 16, as will be seen below, is a significant factor in achieving the reduced metal thickness.

FIG. 3 shows, from left to right, steps in progressively stamping terminals 10 in a continuous stamping operation. In the first step, indicated by reference numeral 42, hole 22 is punched out. In second step 44, ribs 28, 30 are formed by embossing or coining. As shown, rib 28 has a keyhole shape with loop 46 encircling most but not all of hole 22. A pair of parallel portions 48 extend rearwardly from loop 46 to free end portions 50 which extend perpendicularly away from parallel portions 48 and in opposite directions relative to each other. In third step 52 metal is removed to completely define terminal profile 54 on the far right hand side and to partially define terminal sub-profile 56 immediately to the left. Connecting tabs 58 extend between adjacent contact sections 12 to form a continuous strip 60 for further handling and reeling (not shown) for storage and shipping. As is well known, tabs 58 are severed from terminals 10 prior to use.

Terminal profile 54 includes formed contact section 12, connecting strap 20 and a pair of ears 62 extending laterally in opposite directions with free end portions 50 of rib 28 thereon as well as rib 30.

Figure 4:
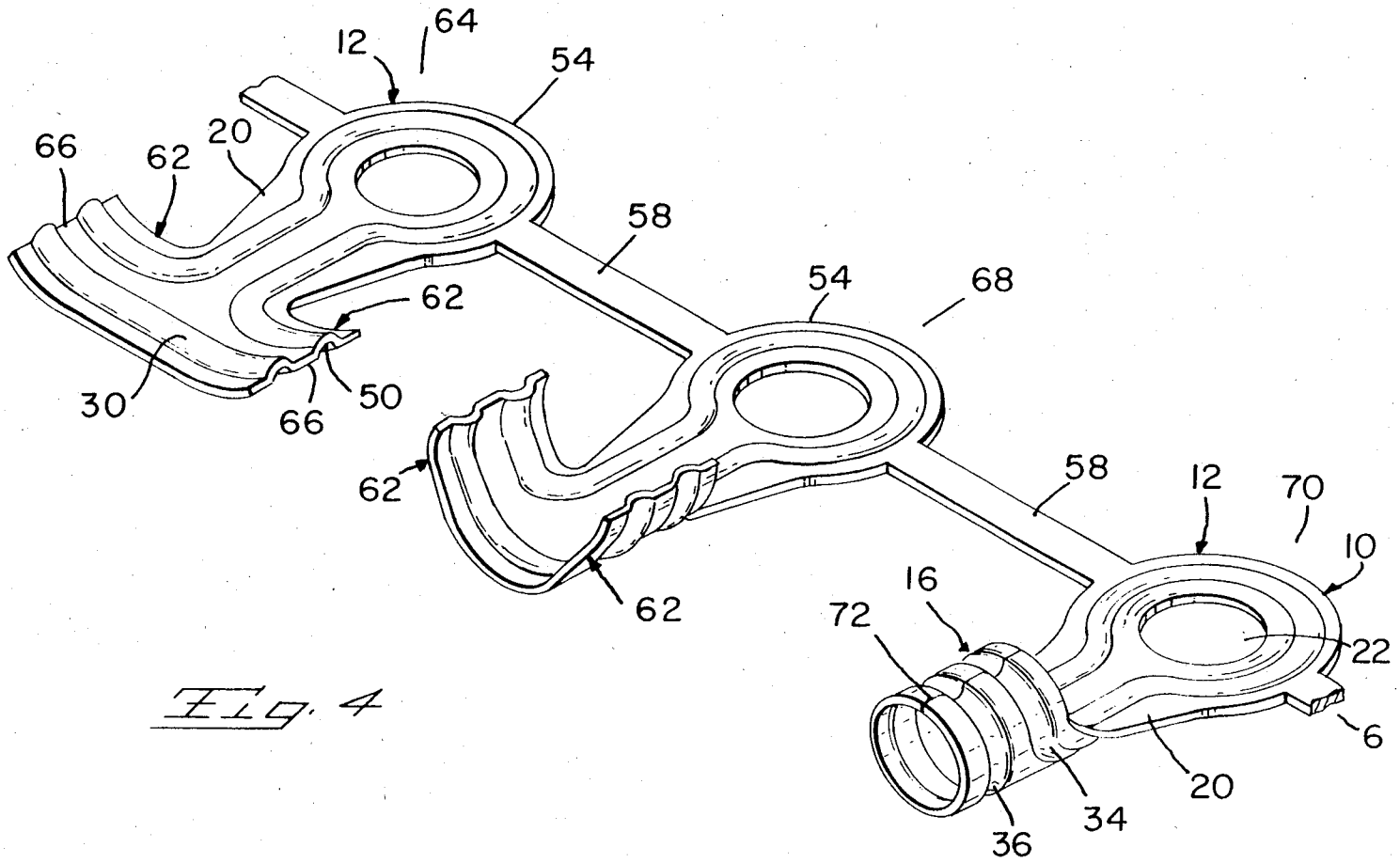
FIG. 4 is a perspective view showing steps in forming the electrical terminal.

FIG. 4 shows steps in forming terminal profile 54 into terminal 10. Forming is done progressively by moving strip 60 through forming stations (not shown). In first step 64 on the left hand side, the free ends 66 of ears 62 are curved up slightly. In second step 68 ears 62 are rolled up to form a U. In final step 70 on the right hand side, ears 62 are rolled into a cylindrical shape to form wire barrel 16. Seam 72 may be brazed, particularly if barrel 16 is not provided with an insulating sleeve 24.

Strips 60 of terminals 10 may next be fed through a continuous molding station (not shown) where insulating sleeve 24 is molded directly onto wire barrel 16. Here the molding material will fill in grooves 34, 36 to secure sleeve 24 to barrel 16.

Figure 5A:
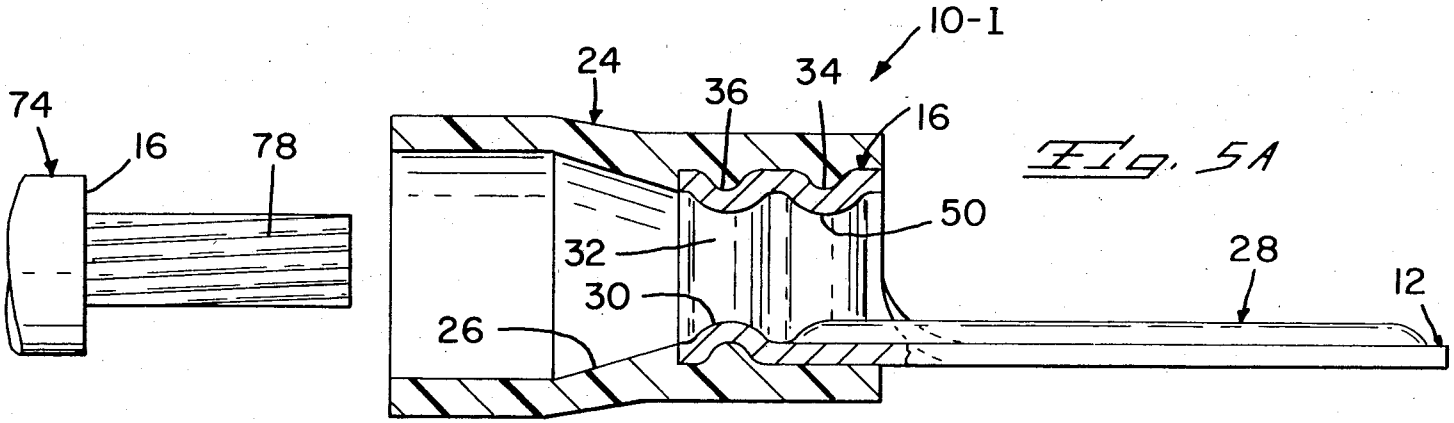
FIGS. 5A and 5B are side sectional views of an electrical terminal being crimped onto an electrical wire.
Figure 5B:
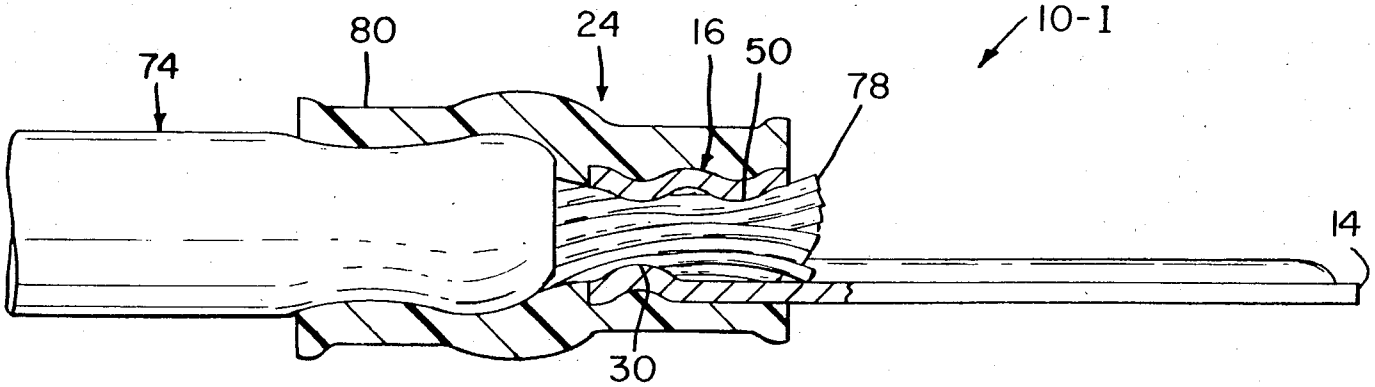

FIGS. 5A and 5B are cross-sectional views of terminal 10-I. These views clearly show sleeve 24 being secured onto wire barrel 16 by means of grooves 34 and 36 receiving the molding material.

Conductor 74, shown to the left of terminal 10-I in FIG. 5A, has insulation jacket 76 removed to bare stranded wire 78 preparatory to termination. In FIG. 5B, conductor 74 has been inserted with stranded wire 78 channeled into wire barrel 16 by means of funnel 26 (FIG. 5A) and crimped therein to effect an electrical connection.

In the crimping process which is well known in the industry, crimping of wire barrel 16 is through sleeve 24 as shown. Rib 28; i.e., free end portions 50, and rib 30 provide concentrated pressure points on wire 78 to enhance electrical conductivity therebetween and to increase retention of wire 78 against pull-out.

Further, the rear portion 80 of insulating sleeve 24 has been crimped around conductor 74 to provide insulation jacket support against transverse conductor movement.

Figure 6:
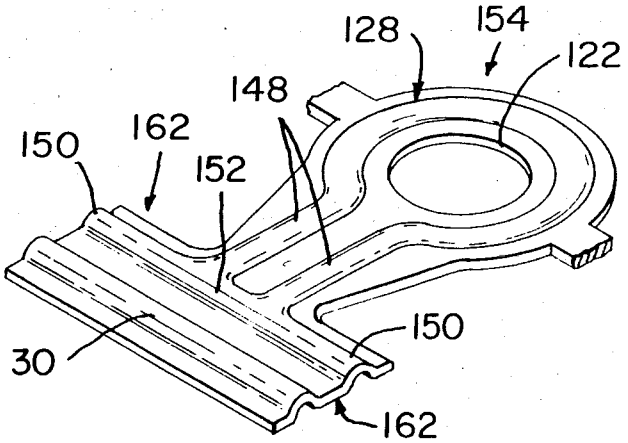
FIG. 6 is a perspective view of an alternate embodiment of the electrical terminal.
Figure 7:
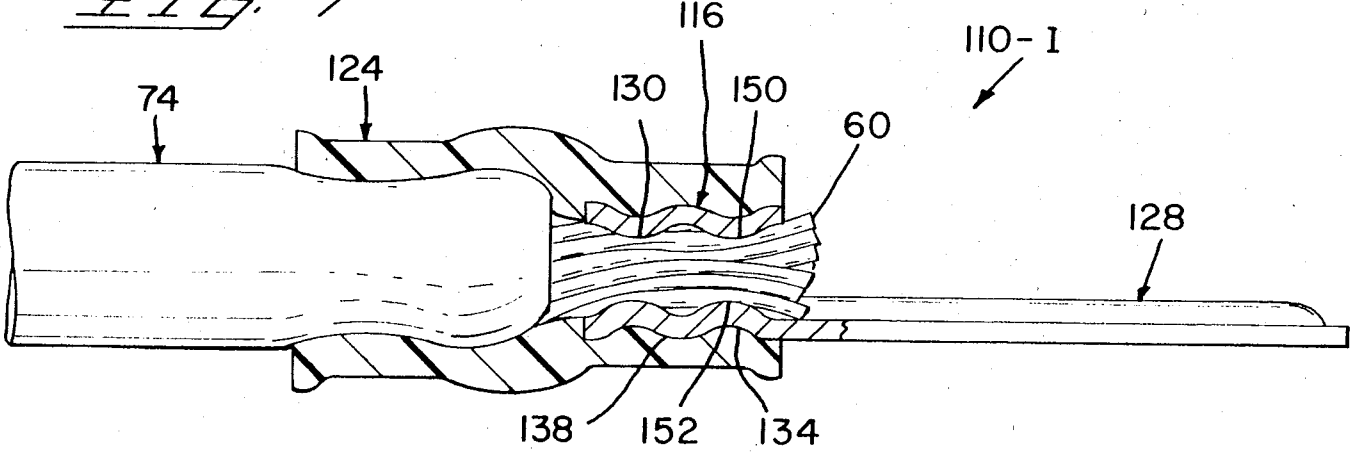
FIG. 7 is a side sectional view of the electrical terminal of FIG. 6 crimped onto an electrical wire.

An alternate embodiment of the electrical terminal of the present invention is shown in FIGS. 6 and 7. This terminal profile, indicated by reference numeral 154, differs from terminal profile 54 only with respect to rib 28. In terminal profile 154 rib 128 completely spans ears 162 with link portion 152 connecting free end portions 150 and parallel portions 148. Thus, as shown in FIG. 7, rib 128 of terminal 110-I extends around the complete circumference of wire 78. Similarly the presence of groove 134 around the complete periphery of surface 138 of barrel 116 increases the security of sleeve 124 thereon.

I claim:

1. An electrical terminal, comprising contact section means at one end for being attached to an electrical device;

wire receiving means at another end for receiving an electrical wire therein and being crimped down around said wire to establish electrical contact therewith; and continuous rib means coined on said contact section means and said wire receiving means, said rib means providing rigidity to said contact section means and providing concentrated pressure points against the wire crimped in said wire receiving means.

2. The electrical terminal of claim 1 wherein said terminal is stamped and formed from relatively thin metal stock.

3. The electrical terminal of claim 1 wherein an insulating sleeve is secured onto said wire receiving means.

4. The electrical terminal of claim 3 wherein said rib means define a groove on the exterior surface of said wire receiving means for securing said insulating sleeve thereto.

5. The electrical terminal of claim 4 wherein said insulating sleeve extends beyond the back of said wire receiving means and provides funnel means for funneling a wire being inserted into said wire receiving means.

6. The electrical terminal of claim 1 wherein said contact means include a hole therethrough with said rib means encircling most of said hole.

7. The electrical terminal of claim 1 further including a second rib means located in said wire receiving means.

8. An electrical terminal formed from sheet metal and for being fastened to an end of an electrical wire, comprising a contact section at one end having attachment means thereon for attaching said electrical terminal to an electrical device;

a closed wire barrel at another end for being crimped around an end of an electrical wire inserted therein; and a first rib embossed into said sheet metal and extending around said contact section adjacent an edge thereof and extending around the interior of said wire barrel, said rib providing rigidity to said contact section and providing means to concentrate pressure against said end of the electrical wire upon the wire barrel being crimped onto the electrical wire end.

9. The electrical terminal of claim 8 further including a second embossed rib located in said wire barrel and spaced from said first rib.

10. The electrical terminal of claim 9 wherein said ribs define grooves on the exterior surface of said wire barrel.

11. The electrical terminal of claim 10 further including an insulating sleeve molded onto said wire barrel with said grooves securing said sleeve thereto.

12. The electrical terminal of claim 11 wherein said attachment means include a post-receiving hole in the contact section with said first rib encircling a portion of said hole.

13. The electrical terminal of claim 12 wherein said sheet metal is relatively thin.

14. A method of making an electrical terminal, comprising the steps of:

punching a hole in a strip of metal;

coining a first rib in said metal, said rib having a general keyhole shape with a loop portion partially encircling said hole, two spaced apart, parallel portions extending from said loop portion and a pair of free end portions extending perpendicularly from said parallel portions and in opposite directions relative to each other;

removing metal to define a contact section with said hole therethrough at one end and laterally extending ears at the other end with said free end portions of said first rib being located thereon; and forming said ears into a cylindrical shape to define a wire barrel with a wire receiving passage therethrough and with said free end portions of said first rib projecting into said passage.

15. The method of claim 14 further including the step of coining a second rib in said metal, said second rib being spaced from and parallel to said free end portions of said first rib.

16. The method of claim 14 further including the step of insulating said wire barrel with a sleeve of insulating material.

17. The method of claim 16 wherein said sleeve is secured on said wire barrel by molding.

18. The method of claim 17 wherein said coining of said first rib defines grooves in the outer surface of said wire barrel and said molding causes molding material to fill said grooves to secure said sleeve onto said wire barrel.

19. The method of claim 14 further including the step of coining a link portion connecting said parallel portions and said free end portions.

20. A stamped and formed electrical terminal, comprising:

a contact section and a wire-receiving section, rib means formed in said contact section and said wire-receiving section, said rib means extending continuously along said contact section and most of said wire-receiving section thereby strengthening said contact section and said wire-receiving section, said rib means in said wire-receiving section defining a concentrated pressure area when said wire-receiving section is crimped onto the end of an electrical conductor.

* * * * *